US006862995B2

(12) United States Patent
Kerr

(10) Patent No.: US 6,862,995 B2
(45) Date of Patent: Mar. 8, 2005

(54) METHOD FOR PRODUCING A LESS LETHAL PROJECTILE

(75) Inventor: James T. Kerr, P.O. Box 853, Acton, CA (US) 93510

(73) Assignee: James T. Kerr, Littlerock, CA (US)

( * ) Notice: Subject to any disclaimer, the term of this patent is extended or adjusted under 35 U.S.C. 154(b) by 0 days.

(21) Appl. No.: 10/725,912

(22) Filed: Dec. 1, 2003

(65) Prior Publication Data

US 2004/0255813 A1 Dec. 23, 2004

Related U.S. Application Data

(62) Division of application No. 10/054,381, filed on Jan. 21, 2002, now Pat. No. 6,655,294.

(51) Int. Cl.[7] ..... F42B 10/00

(52) U.S. Cl. ..... 102/502; 86/53; 473/594; 206/528

(58) Field of Search ..... 102/502, 444; 86/54, 55, 57, 53; 73/467, 469; 473/594; 206/528, 530

(56) References Cited

U.S. PATENT DOCUMENTS 3,397,777 A * 8/1968 Stephens ..... 206/527
3,713,840 A * 1/1973 Hostetler et al. ..... 426/29
3,990,872 A * 11/1976 Cullen ..... 96/6
6,202,562 B1 * 3/2001 Brunn et al. ..... 102/502
6,393,992 B1 * 5/2002 Vasel et al. ..... 102/502

FOREIGN PATENT DOCUMENTS

GB 2 092 108 A * 8/1992

* cited by examiner

*Primary Examiner*—Stephen M. Johnson
(74) *Attorney, Agent, or Firm*—Frank L. Zugelter

(57) ABSTRACT

A bean bag (15) installable in a cartridge for use as a less-lethal projectile in striking a target without killing or seriously injuring the target. A doubled-back open-sleeved configuration (27) of the fabric-constructed material includes a compartment in a shorter portion (33) interiorly disposed to a longer portion (36) of the opened-sleeved configuration (27), pellets (23) pre-measured by weight substantially filling the compartment (22). The length (26) of the open-sleeved configuration of the material for the bean bag 15 is determined by weight rather than by its length. The shorter portion (33) and longer portion (36) are fastened together as at (34) thereby determining the size of compartment 22 for the weighted pellets (23). A flowing structure (24) is included in the longer portion (36) to provide stabilization in flight of the bean bag 15 while a peripheral curl or roll (25) along the open end of the flowing (24) provides accuracy to the target as the bean bag 15 is propelled from its cartridge detonated in a gun weapon.

6 Claims, 3 Drawing Sheets

METHOD FOR PRODUCING A LESS LETHAL PROJECTILE

This application is a divisional of 10/054,381, filed on Jan. 21, 2002, now U.S. Pat. No. 6,655,294.

TECHNICAL FIELD

The invention is related to less-lethal projectiles shot from a gun or weapon, and is particularly directed to its ammunition in the product form of a bean bag, for striking a target such as a living human being or animal, without killing or seriously injuring such being, and to the process by which it is made.

BACKGROUND TO THE INVENTION a) Background to the Invention

Peaceful control of mobs, riot participants, picketers, and, individuals intent upon committing a criminal act, has been a constant goal-alternative to lethal force, for not only police authorities but also to trained and certified persons seeking to defend themselves against a criminal act by one or more persons. The technology of perfecting an ammunition of a less-lethal nature was found in a major inception in this country during the 1960's, presumably by The MBA Company (Austin, Tex.) later bought out by Trebor Corporation in 1980 existing at that time in Dublin and Pleasanton, Calif. Various non-lethal projectiles have been generated before and since then and are disclosed in the following U.S. Letters patent, and possibly others classified in the United States Patent Office patent classification, Class 102, Ammunition and Explosives, including subclass 502 in Class 102, and elsewhere: U.S. Pat. Nos. 1,741,901; 3,049,828; 3,710,720; 3,733,727; 3,782,286; 3,791,303; 3,820,465; 3,865,038; 3,901,158; 3,911,824; 3,952,662; 5,450,795; 4,204,474; 4,823,702; 4,942,818; 5,009,164; 5,035,183; 5,086,703; 5,221,809; 5,225,628; 5,317,163; 5,361,700; 5,375,529; 5,450,795; 5,565,649; 5,639,526; 5,652,407; 5,654,524; 5,691,501; 5,786,546; 5,814,753; 5,831,199; 5,880,398; and 5,936,190.

b) Problems in the State-of-the Art

The bean bag ammunition technology to date has continued to advance in kind and degree for achieving a perfected goal, however, actual practice, experience, and technology in seeking perfected protection in its various formats, indicated in some of the above noted patents, has not yet been attained, as the problems of poor stabilization of the ammunition in flight, poor accuracy in the line of flight to the target, and poor material which continues to break sometimes spewing its shot randomly, thus hindering an efficacious effectiveness at the target, remain.

c) Need for the Invention

The need remains to perfect a less-lethal projectile in a fuller sense, namely, one which would stun or effectively incapacitate a living being without killing or seriously injuring such being. With a human being who would be clothed in kind and degree, this invention advantageously approaches such criteria in its operation of striking a human being.

SUMMARY OF THE INVENTION

This invention is directed to a perfected less-lethal ammunition suitable for installation in a cartridge or shell of a projectile found in a gun or weapon, such as a conventional handgun, such as for example, in a 12-gauge shotgun and in the process by which it is formed. The ammunition for the projectile takes a product form commonly referred to as a "bean bag", and has a frontal compartment or chamber contiguous to its nose, pre-measured weighted pellets contained in and substantially filling the compartment sized for the weighted pellets, a flowing structure, providing stability of the bean bag in flight, trailing but separated from the compartment by a fastening device for the bean bag, and a peripheral curl or roll at the edge of the open end of the flowing structure which provides accuracy in the flight of the bean bag to its target after being propelled from its weapon or gun. The bean bag is formed from a tubular open-ended sleeve of non-frangible, non-ruptureable, material which in its fabric construction of the bean bag does not break upon impact on a target, while efficaciously effecting a mushrooming shape upon such impact, thus preventing penetration, killing or seriously injuring a living target or another person. The tubular sleeve's length is determined by the weight of the fabric of the tubular sleeve rather than by its length. The bean bag's weight of the total pellets to be contained in substantially filling the compartment is determined by weight of their total number and not the number itself disposed in the compartment. Subsequent to the fastening between the compartment's body and the flowing structure that trails behind the compartment's body, a peripheral curl or roll is formed around and at the open end of the trailing structure for providing accuracy towards a target during flight of the bean bag.

In the formation of the bean bag, from an indeterminate length of a tubular open-end sleeve a definite length by weight of the open-ended sleeved material is cut and its one end is slipped over a mandrel, such as a hollow plastic tube firmly supported in a fixed support base or receptacle, to the extent of an indicium marked at a level about the mandrel or tube. The indicium signals the proper position fors the open end of a shorter portion of the sleeve, the shorter portion to form the compartment's body and in which the weighted shot is to be contained. A knotted cord or the like closes off this shorter portion from the remainder of the sleeve at the end of the mandrel on to which the sleeve has been first introduced. The remainder of the sleeve above such end of the mandrel is longer than the length of the shorter portion, and lapped or doubled back over the shorter portion to its fullest extent, i.e., being contiguous to the sleeve's material at the closed-off level at the mandrel's end and about the entire shorter portion itself, extending at its other and open end beyond or below the indicium on the tube, thus beyond the open end of the shorter portion, thereby preparing in the formation of a flowing structure for the bean bag. The tube and sleeve at this point of assembly is removed from the mandrel's support base and turned or inverted so that a measured weight of pellets, such as shotgun lead pellets, can be introduced into the hollow mandrel or tube and extending past its bottom to the closed-off level of the shorter portion of the sleeve still wrapped on the tube, i.e., the bottom of the weighed pellets seat within the tube, proximate to the knotted cord on the outside of the sleeve, and up through the hollowness of the tube. The mandrel is removed from the sleeve and now the pellets are housed within the shorter portion.

The shorter portion of the sleeve with its pellets at this point is placed into the fixed receptacle. The top rim of an annulus attached to the inner wall of the receptacle is the indicator for determining the location of a fastening device, such as another cord or the like to be applied, and which when applied about the outer longer portion of the sleeve determines the size of the compartment that is generated within the interiorly disposed shorter portion and which size satisfies the filling of the compartment to its fullest with the pre-measured weighted shot in front of the fastening device. This is important for effecting the desired result of less-lethal impact upon proper use of the gun or weapon from which the bean bag is propelled. With the fastening together of the interiorly disposed shorter sleeve portion and the longer sleeve portion, the longer sleeve portion remains to generate the flowing structure trailing in a fanned-out or cone-like fashion. A peripheral curl or roll then is applied along the open end of the trailing portion of the longer portion to effect an accuracy in line of flight of the bean bag to its target. After the fastening together and the formation of the curl or roll have been completed, the bean bag of this invention has been produced. It is now ready for inclusion in a cartridge or shell of the projectile from which it can be discharged in the customary manner of detonating a primer at the rear of the cartridge or shell to ignite the cartridge's propellant to propel the bean bag from the barrel of its gun or weapon towards its target. The filling of the cartridge at its leading open end with the perfected bean bag whereby completion of the assembly of the cartridge or shell is accomplished in a conventional manner by customary techniques known in the ammunition industry.

An object of this invention is to provide a novel bean bag for a projectile of ammunition.

A further object of this invention is to prevent killing or serious injury to a living target.

A still further object of this invention is to provide a less-lethal projectile whose line of fire from the weapon from which it is fired is true to its target.

Another object of this invention is to provide protection to innocent persons against persons intent to riot and against persons intent to commit a criminal act upon another or others.

A still further object of this invention is to provide police, other law enforcement authorities, and trained and certified users of less-lethal weapons with an effective tool to control or otherwise minimize or eliminate unpeaceful assemblies of human beings.

Yet another object of the invention is to provide law enforcement with an alternative to lethal force for criminal apprehension.

Still another object of the invention is to provide an effective tool against animals for the purpose of preventing them from injuring others.

These and other objects and advantages will become apparent by a full and complete reading of the following description, its appended claims, and the accompanying three (3) drawing sheets and seven (7) FIGURES thereon.

BEST MODE FOR CARRYING OUT THE INVENTION

Figure 1:
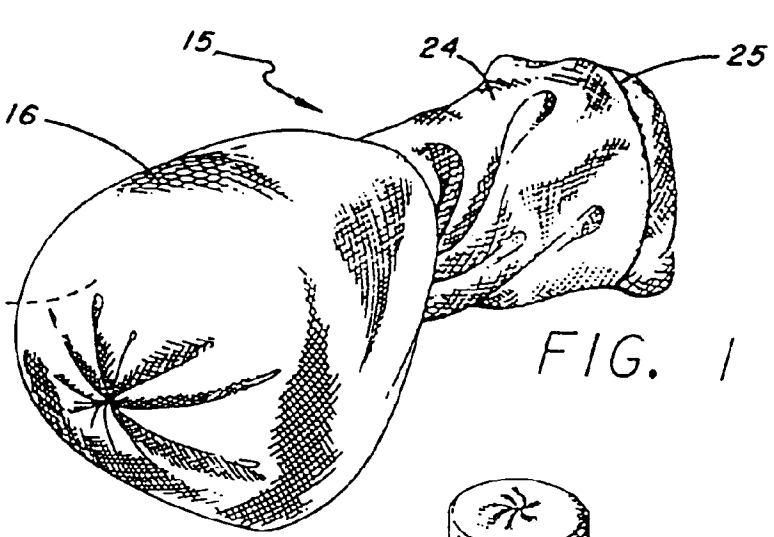
FIG. 1 is a perspective view of a projectile's bean bag product of this invention, showing a nose for the product and a flowing structure formed by the fastening together of constructed fabric material folded back upon itself with a curl or roll of the bean bag formed at its rear or open end.
Figure 5:
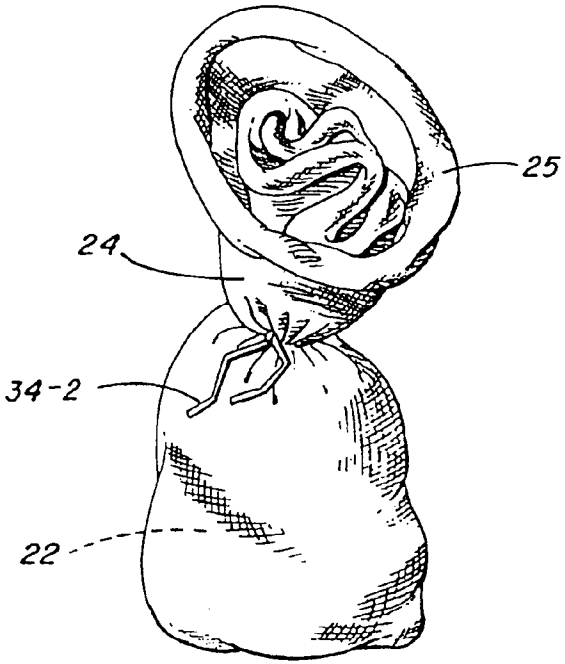
FIG. 5 is a view of FIG. 4 after a pre-measured weight of pellets or shot have been introduced into the FIG. 4 assembly and removal of the mandrel, with a fastening together of the shorter and longer sleeve portions at a point or level applied to such assembly to form the pellets' compartment and to form a flowing structure trailing the fastened point or level and showing a periphery curl or roll at the open end on the longer sleeve portion beyond the open end of the shorter portion of the sleeve.

Referring now to the accompanying drawing FIGURES wherein reference characters correspond to like numeral hereinafter, FIG. 1 illustrates an embodiment of the bean bag 15 used in a less-lethal projectile of this invention. Bean bag 15 in its generated product form is of a fully tubular construction of a non-frangible, non-ruptureable nature which upon impact in its use with its target reconfigures its frontal portion 16 into a mushroom configuration upon impact, one which does not kill or seriously injure a living target when hit by the bean bag 15. Bean bag 15 is formed by a double layer of material that captures within its formed chamber or compartment 22, FIGS. 1, 5, a pre-measured weight of lead shot or pellets 23, FIG. 4, the compartment 22 being separate or apart from a flowing structure 24 that stabilizes the flight of projectile 15 towards its target in the operation of the invention.

This invention is directed to a perfected less-lethal ammunition suitable for installation in a cartridge or shell of a projectile found in guns, such as a conventional handgun, such as for example, in a 12-gauge shotgun and in the process by which it is formed. The ammunition for the projectile takes a product form commonly referred to known as a "bean bag"15, and has a frontal compartment 22, FIG. 1, or chamber contiguous to its nose, pre-measured weighted pellets 23, FIG. 4, contained in and substantially filling the compartment 22, a flowing structure 24, FIGS. 1, 5, providing stability of the bean bag 15 in flight, trailing but separated from the compartment 22 by a fastening device, and a peripheral inwardly-turned curl or roll 25, FIGS. 1, 5, at the edge of the open end of the flowing structure 24 which provides accuracy in the flight of the bean bag 15 to its target after being propelled from its weapon or gun. The bean bag 15 is formed from a tubular open-ended sleeve of non-frangible, non-ruptureable, material which in its fabric construction of the bean bag 15 does not break upon impact on a target, while effecting a mushrooming shape upon such impact, thus preventing penetration, killing or seriously injuring a living target or another person from spewed shot. The tubular sleeve's length is determined by the weight of the fabric of the tubular sleeve rather than by its length. The bean bag 15's weight of the total pellets 23 to be contained in substantially filling the compartment 22 is determined by weight of their total number and not the number itself disposed in the compartment 22. Subsequent to the fastening between the compartment 22's body and the flowing structure 24 that trails behind the compartment 22's body, the peripheral curl or roll 25 is formed around and at the open end of the trailing structure 24 for providing accuracy towards a target during flight of the bean bag 15.

Figure 3:
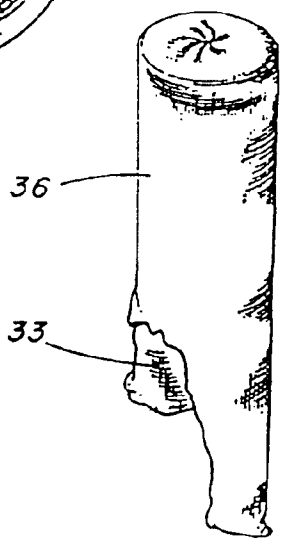
FIG. 3 is a view of the sleeve illustrated in FIG. 2, however, its longer portion having been folded back over the shorter sleeve portion, the longer sleeve portion extending beyond the open end of the shorter sleeve portion.
Figure 2:
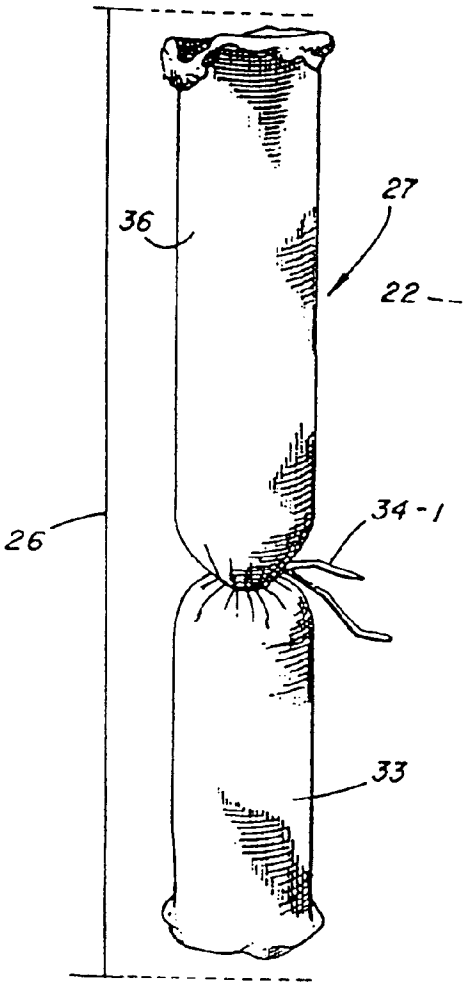
FIG. 2 is a view of an open-ended sleeve of definite length of a constructed fabric material closed off along its length at a point at which one sleeve portion is of greater length than that of a second and shorter sleeve portion caused by a closing off of the constructed fabric material.
Figure 4:
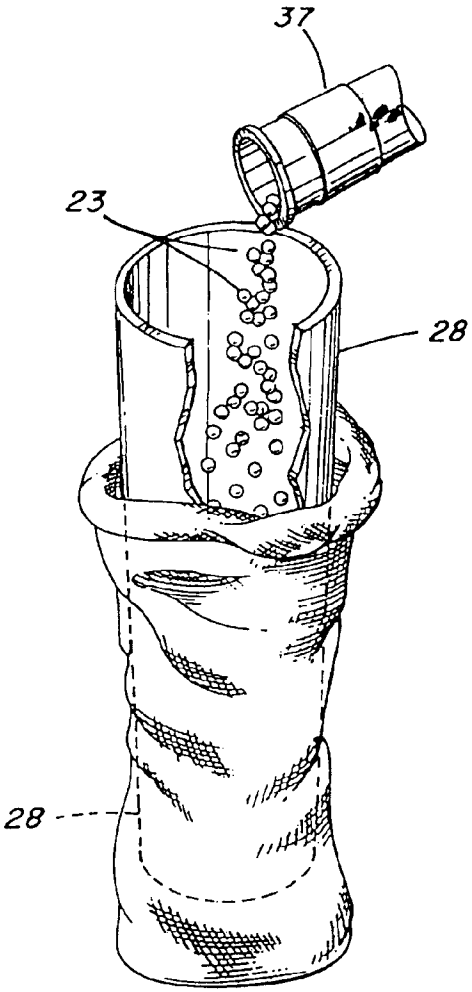
FIG. 4 is a view of FIG. 3's sleeve, however, inverted and slipped onto a hollow mandrel, over its position in FIG. 3, for introducing pellets or shot through the mandrel into the interiorly disposed shorter sleeve portion of the FIG. 3 assembly.
Figure 6:
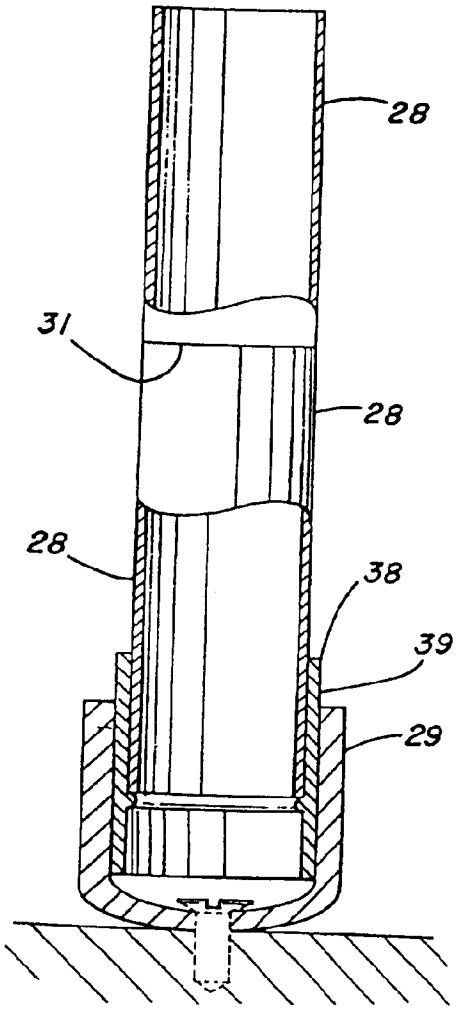
FIG. 6 is a diagrammatic view of a dual-purpose receptacle, for supporting the mandrel during the determination of the length of the shorter sleeve portion by an indicium, shown preferably on the mandrel, and including an annulus attached to the inner wall of the receptacle and by the top rim of which the pellets' compartment is sized for a full filling of the pre-measured weighted pellets into the shorter sleeve portion.

In the formation of the bean bag 15, the already determined length 26, FIG. 2, by weight of the open-ended sleeved material 27, is slipped over a mandrel 28, FIGS. 4, 6, such as a hollow plastic tube firmly supported in a fixed support base or receptacle 29, to the extent of an indicium 31 marked at a level about the mandrel or tube 28. The indicium 31 signals the position of the open end of a shorter portion 33, FIG. 2, of the sleeve 27 that forms the compartment 22's body, and in which the weighted shot is to be contained. A strong suitably knotted cord 34-1, FIG. 2, or the like, closes off and separates this shorter portion from the remainder or longer portion 36 of sleeve 27 adjacent to its end of the mandrel 28 on to which the sleeve is first introduced. The remainder 36 of the sleeve adjacent to its end of the mandrel 28, which has been generated in sleeve 27 by means of the location of the indicium 31 on the mandrel 28 as being longer than the length of the shorter portion 33, is then lapped or doubled back over the shorter portion 33 to its fullest extent, i.e., being contiguous to the material at the closed-off level at the mandrel 28's end and about the entire shorter portion 33 itself, extending at its other end beyond or below the indicium 31 on the tube, as illustrated in FIG. 3, thus beyond the open end of the shorter portion 33, thereby forming the flowing structure 24, FIG. 1, for the bean bag 15, over that of the shorter portion 33. The tube and sleeve at this point of assembly is removed from mandrel 28's support base 29 and turned or inverted so that a measured weight of pellets 23, such as shotgun lead pellets, can be introduced into the hollow mandrel or tube 28, such introduction represented by a nozzle 37, FIG. 4, of a shot dispensing machine, identified hereinafter. Pellets 23 extend to the closed-off level of the shorter portion 33 of sleeve 27 still wrapped on the tube, i.e., the bottom of the weighed pellets 23 seat within the tube, proximate to the knotted cord 34-1 on the outside of the sleeve, and up through the hollowness of tube 28. The mandrel 28 is removed from sleeve 27 and now pellets 23 are housed within the shorter portion 33.

Figure 7:
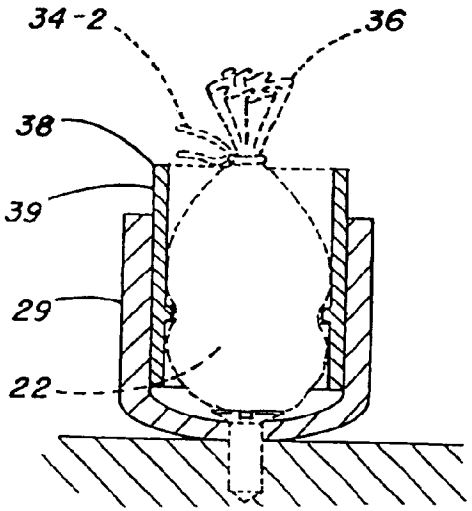
FIG. 7 is a diagrammatic view of FIG. 6 but with mandrel removed and an outline of a bean bag's frontal portion including its shorter sleeve portion, the top of the annulus determining the proper size of the compartment for substantially containing a pre-measured weight of pellets or shot, and the bean bag being fastened at such annulus' top thereby separating the compartment from the flowing structure, after which a completed assembly of the bean bag follows by the addition of an inwardly-turned curl or roll formed on the open end of the longer sleeve portion and as illustrated in FIGS. 1 and 5.

The shorter portion 33 of the constructed fabric's sleeve 27 at this point is placed into the fixed receptacle 29. The top rim 38 of an annulus 39 attached to the inner wall of the receptacle 29 is the indicator for determining the location of a fastening device such as another cord 34-2, FIG. 7, or the like to be applied, and which when applied about the outer longer portion 36 of the sleeve determines the size of the compartment 22 that is generated within the interiorly disposed shorter portion 33 and which size satisfies the filling of the compartment 22 to its fullest with the pre-measured weighted shot in front of the fastening device 34-2. This is important for effecting the desired result of less-lethal impact upon proper use of the gun or weapon from which the bean bag 15 is propelled. With the fastening together of the interiorly disposed shorter sleeve portion 33 and the longer sleeve portion 36, the longer sleeve portion 36 remains to generate the flowing structure 24 trailing in a fanned-out or cone-like fashion. The peripheral curl or roll 25 then is applied by manually turning inwardly the open end of the trailing portion of the longer portion 36. After the fastening together and the formation of the curl or roll 25 have been completed, the bean bag 15 of this invention has been produced. The curl or roll 25 is now ready for insertion into the open front end of a cartridge or shell of the projectile from which bean bag 15 can subsequently be discharged in the customary manner of actuation of a detonated primer at the rear of the cartridge or shell, namely, detonating the primer to ignite the cartridge's propellant to propel the bean bag 15 from the barrel of its gun or weapon towards its target. The filling of the cartridge at its leading open end with the perfected bean bag 15 after other elements for the cartridge have been first installed in the cartridge is accomplished in a conventional manner by customary techniques known in the ammunition industry.

The preferred fabric-constructed material in the form of the open-ended sleeve 27 is KEVLAR material, style KEV-I, size M33677, manufactured by Green Mountiain Knitting, 19 Welihouse Road, Milton Vt. 05468. The shot dispensing machine by which a pre-measured weight of lead shot, represented by nozzle 37 in FIG. 4, is determined and dispensed from and into mandrel 28 is Model # 600 JR MARK V 12 gauge, part # 844712, manufactured by MEC, a subsidiary of the Mayville Engineering Company, Inc., 715 South Street, Mayville Wis. 53050.

Various changes and modifications can be made in the bean bag 15 and its process of making without departing from the scope and spirit of the appended claims. Although indicium 31 is marked on the mandrel 28, it could well be marked on a sleeve itself. The closing off of the shorter sleeve and the longer sleeve can be accomplished also by twisting them about each other after placement of the shorter sleeve to the indicium 31 on the mandrel 28.

INDUSTRIAL APPLICABILITY

The invention is applicable to the ammunition and explosive industries.

I claim:

1. A process of making a bean bag product for installation within a cartridge for a gun for a less-lethal purpose upon propelling the bean bag from such cartridge upon the latter's detonation comprising applying one end of an open-ended sleeve of a length consonant with a predetermined weight of a fabric-constructed material to a hollow mandrel to the extent of an indicium for indicating the length of a shorter portion for the sleeve over a longer portion for the sleeve not applied to the mandrel, closing off the sleeve at the end of the mandrel to which the sleeve was applied thereby delineating a shorter portion on the sleeve on the mandrel from a longer portion on the sleeve not applied to the mandrel, doubling back the longer portion of the sleeve over the shorter portion of the sleeve while the shorter sleeve is on its mandrel, a flowing structure thereby being formed on the longer portion of the sleeve while the shorter portion is on the mandrel, removing the doubled-back sleeve of the shorter portion and the longer portion from the mandrel, filling the shorter portion of the sleeve with a plurality of pre-measured-by-weight pellets, fastening together the shorter portion and the longer portion forming the doubled-back sleeve at the level at which the pellets have filled the shorter portion thereby forming a substantially filled compartment for the bean bag, and forming a peripheral curl on the flowing structure of the longer portion of the doubled-back sleeve.

2. The process of claims 1 including inwardly turning of the open end of the flowing structure trailing beyond the shorter sleeve portion.

3. The process of claim 1 including cutting from an indeterminate length of such fabric-constructed material a definite length of a sleeve that is first determined by weight to be of the proper length for forming the bean bag.

4. The process of claim 3 including weighing of an indefinite length of the sleeve for determining its proper length by weight for producing the bean bag.

5. The process of claim 4 wherein the indicium is mounted on the hollow mandrel.

6. The process of claim 1 wherein the indicium is mounted on the hollow mandrel.

* * * * *